US006394620B1

(12) United States Patent
Wang

(10) Patent No.: US 6,394,620 B1
(45) Date of Patent: May 28, 2002

(54) SHAPE LAMP

(76) Inventor: Yu-Mei Wang, No. 41, Lane 343, Luho Rd., Sec. 5, Homei Town, Changhua County (TW)

( * ) Notice: Subject to any disclaimer, the term of this patent is extended or adjusted under 35 U.S.C. 154(b) by 0 days.

(21) Appl. No.: 09/820,615

(22) Filed: Mar. 30, 2001

(51) Int. Cl.[7] ..... F21P 1/00
(52) U.S. Cl. ..... 362/121; 362/806; 362/807
(58) Field of Search ..... 362/121, 806, 362/807, 808

(56) References Cited

U.S. PATENT DOCUMENTS 1,728,547 A * 9/1929 Herweg ..... 362/121
1,977,126 A * 10/1934 Graf ..... 362/807
RE19,859 E * 2/1936 Graf ..... 362/807
5,430,626 A * 7/1995 Leffel ..... 362/121

* cited by examiner

*Primary Examiner*—Thomas M. Sember
(74) *Attorney, Agent, or Firm*—Rosenberg, Klein & Lee

(57) ABSTRACT

A shape lamp includes a hollow polygonal frame base having rectangular openings and triangular openings. A lamp body shaped like a quadrilateral pyramid is detachably fastened to the frame base by a hook joint. The lamp body has a hanging plate disposed outside the polygonal frame base for hanging. A plurality of ornamental quadrilateral pyramids is selectively detachably fastened to the rectangular openings of the polygonal frame base by a hook joint; and a plurality of ornamental triangular pyramids is selectively detachably fastened to the triangular openings of the polygonal frame base by a hook joint.

2 Claims, 4 Drawing Sheets

SHAPE LAMP

BACKGROUND OF THE INVENTION

The present invention relates to lamps and, more particularly, to a shape lamp, which is detachable and, can be alternatively easily arranged into any of a variety of forms to show different designs.

A variety of shape lamps have been disclosed, and have appeared on the market. These conventional shape lamps show a particular design. However, when a shape lamp is made, its design is not changeable. Further conventional shape lamps occupy much storage space because they are not detachable.

SUMMARY OF THE INVENTION

The present invention has been accomplished to provide a shape lamp, which eliminates the aforesaid drawbacks. It is one object of the present invention to provide a shape lamp, which is detachable. It is another object of the present invention to provide a shape lamp, which can easily be assembled and installed without the use of tool means. It is still another object of the present invention to provide a shape lamp, which can be arranged into any of a variety of forms to show different designs. It is still another object of the present invention to provide a shape lamp, which can be arranged into different forms for use as a wall lamp, ceiling lamp, or work lamp. According to one aspect of the present invention, the shape lamp comprises a hollow polygonal frame base having rectangular openings and triangular openings, a lamp body shaped like a quadrilateral pyramid and detachably fastened to the frame base by a hook joint, the lamp body having a hanging plate disposed outside the polygonal frame base for hanging, a plurality of ornamental quadrilateral pyramids selectively detachably fastened to the rectangular openings of the polygonal frame base by a hook joint, and a plurality of ornamental triangular pyramids selectively detachably fastened to the triangular openings of the polygonal frame base by a hook joint. According to another aspect of the present invention, the lamp body comprises a hanging plate disposed at the topside thereof for hanging. According to still another aspect of the present invention, the lamp body can be used with the polygonal frame base as a hand light after removal of the ornamental quadrilateral pyramids and the ornamental triangular pyramids from the polygonal frame base.

DETAILED DESCRIPTION OF THE PREFERRED EMBODIMENT

Figure 1:
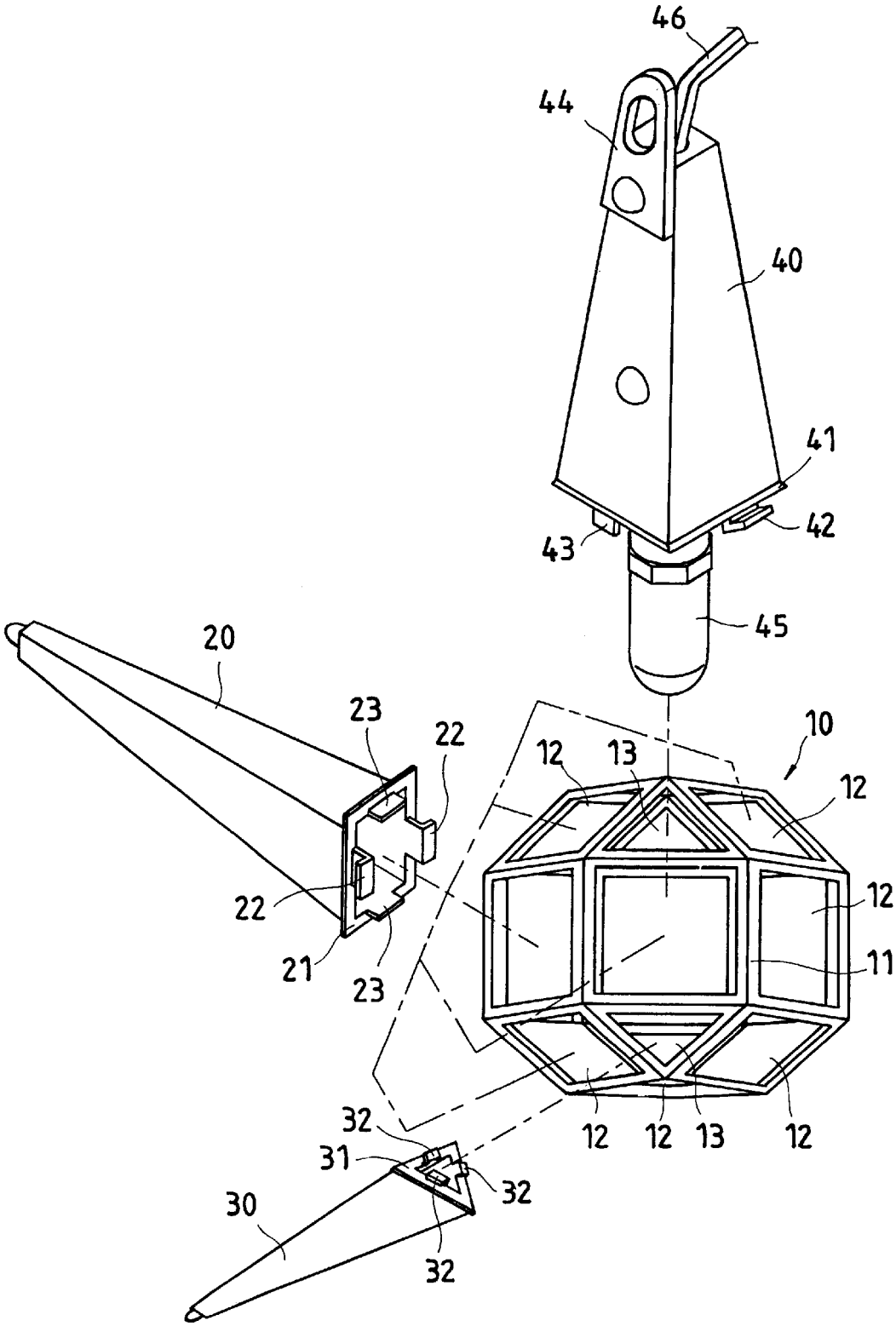
FIG. 1 is an exploded view of the present invention.
Figure 2:
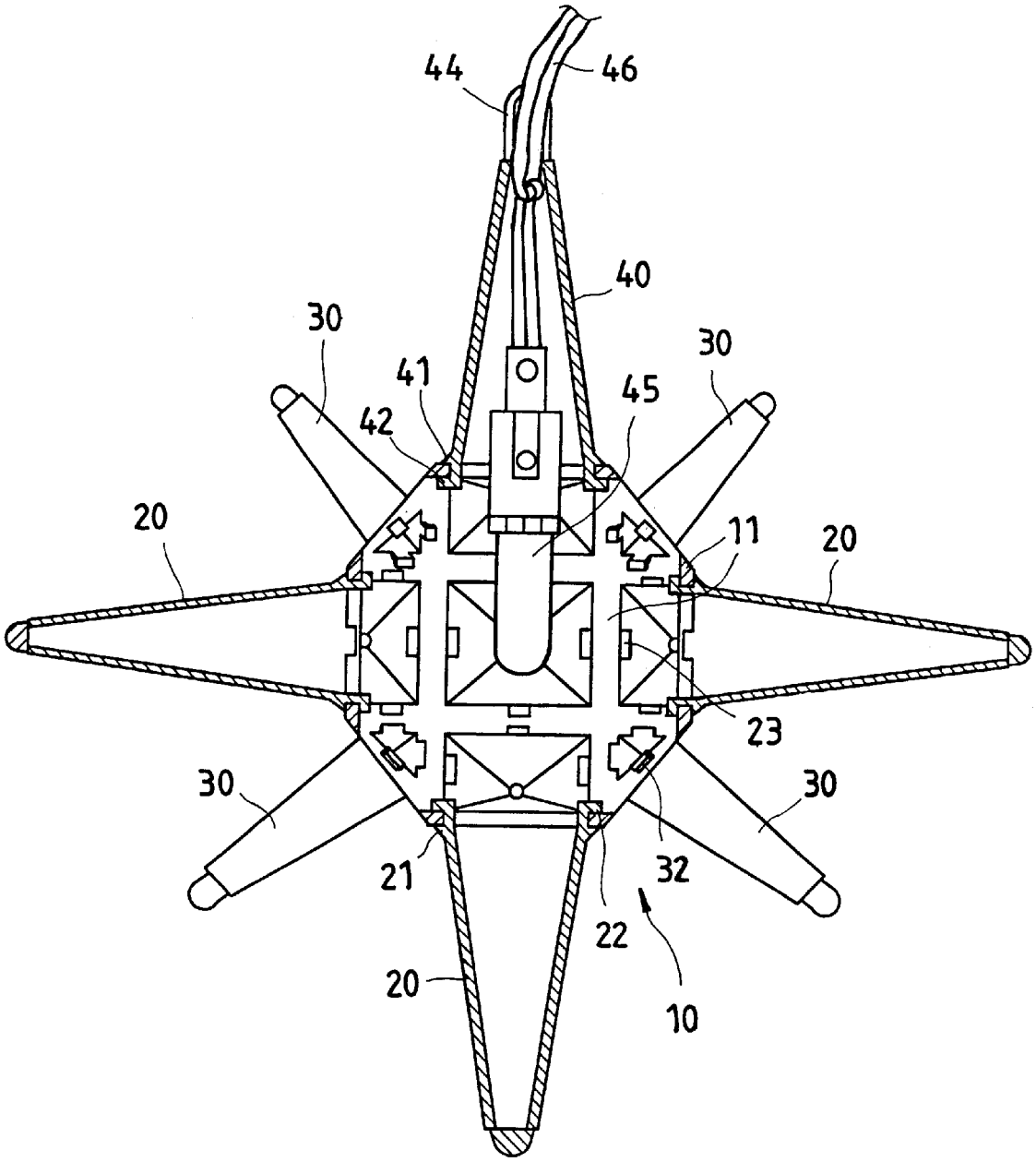
FIG. 2 is a sectional assembly view of the present invention.
Figure 3:
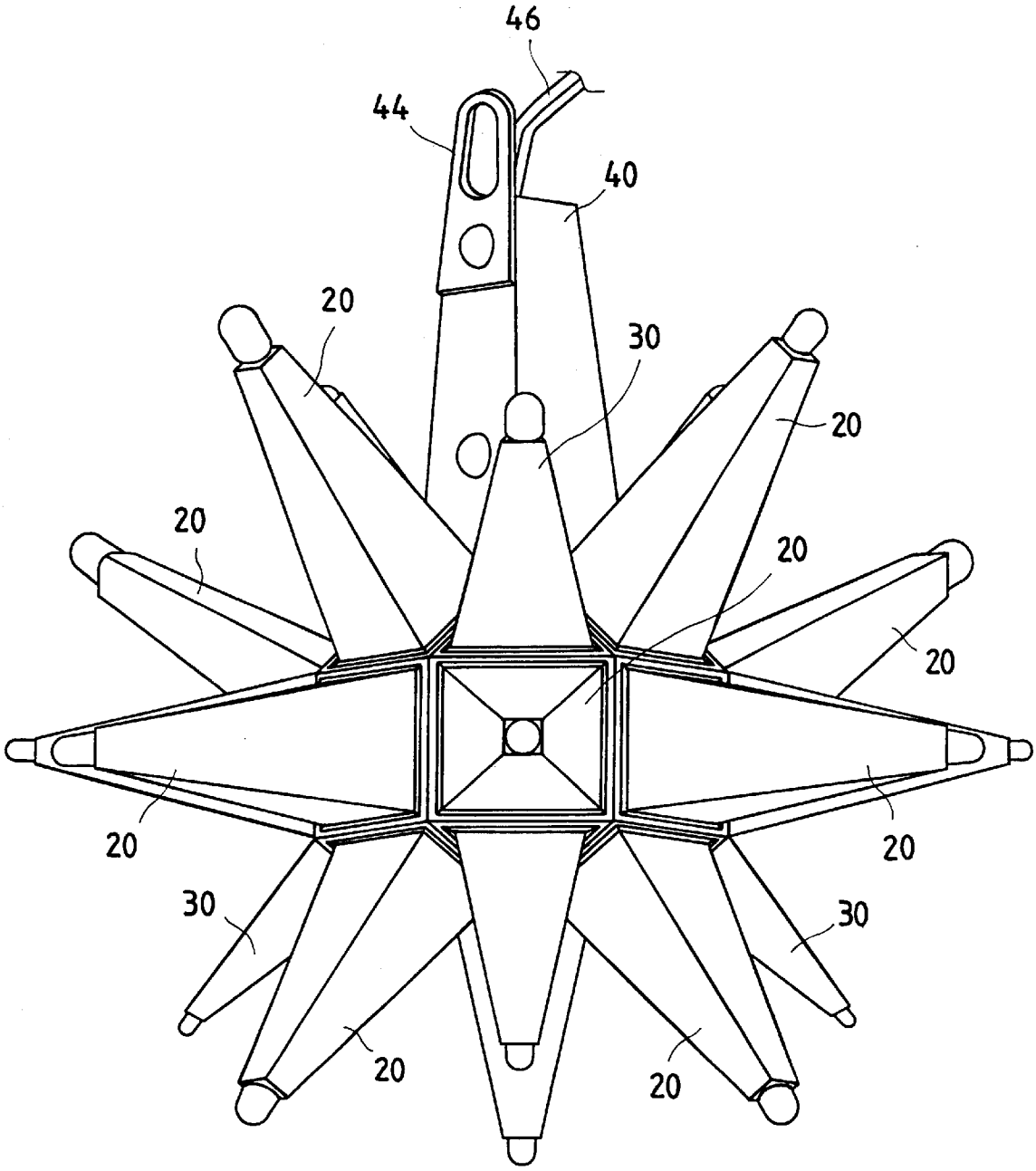
FIG. 3 is an elevational assembly view of the present invention.

Referring to FIGS. from 1 through 3, a shape lamp in accordance with the present invention is generally comprised of a polygonal frame base 10, a lamp body 40, a plurality of ornamental quadrilateral pyramids 20, and a plurality of ornamental triangular pyramids 30. The polygonal frame base 10 is a hollow frame comprising a plurality of frame ribs 11 connected to one another and defining a plurality of rectangular openings 12 and triangular openings 13. The lamp body 40 is shaped like a quadrilateral pyramid comprising a bottom locating flange 41 stopped against the frame ribs 11 of the polygonal frame base 10 around one rectangular opening 12, a plurality of bottom hooks 42 and bottom stop plates 43 respectively engaged into one rectangular opening 12 of the polygonal frame base 10 to secure the lamp body 40 to the polygonal frame base 10 positively, a lamp tube 45 disposed at the bottom side thereof and suspending in the polygonal frame base 10, a hanging plate 44 disposed at the top side thereof for hanging, and a power cord 46 extended out of the top side and adapted to receive electricity for the lamp tube 45. The ornamental quadrilateral pyramids 20 each comprise a bottom locating flange 21 stopped against the frame ribs 11 of the polygonal frame base 10 around one rectangular opening 12, a plurality of bottom hooks 22 and bottom stop plates 23 respectively engaged into one rectangular opening 12 of the polygonal frame base 10 to secure the respective ornamental quadrilateral pyramid 20 to the polygonal frame base 10 positively. The ornamental triangular pyramids 30 each comprise a bottom locating flange 31 stopped against the frame ribs 11 of the polygonal frame base 10 around one rectangular opening 12, and a plurality of bottom hooks 32 respectively engaged into one triangular opening 13 of the polygonal frame base 10 to secure the respective ornamental triangular pyramid 30 to the polygonal frame base 10 positively.

Referring to FIGS. from 1 through 3 again, the ornamental quadrilateral pyramids 20 and the ornamental triangular pyramids 30 can be selectively fastened to the polygonal frame base 10 to show one of a variety of patterns. Because the lamp body 40, the ornamental quadrilateral pyramids 20 and the ornamental triangular pyramids 30 are respectively fastened to the polygonal frame base 10 by the respective bottom hooks 42;22;32, the shape lamp is detachable. When not in use, the lamp body 40, the ornamental quadrilateral pyramids 20 and the ornamental triangular pyramids 30 can easily be detached from the polygonal frame base 10 to minimize storage space.

Figure 4:
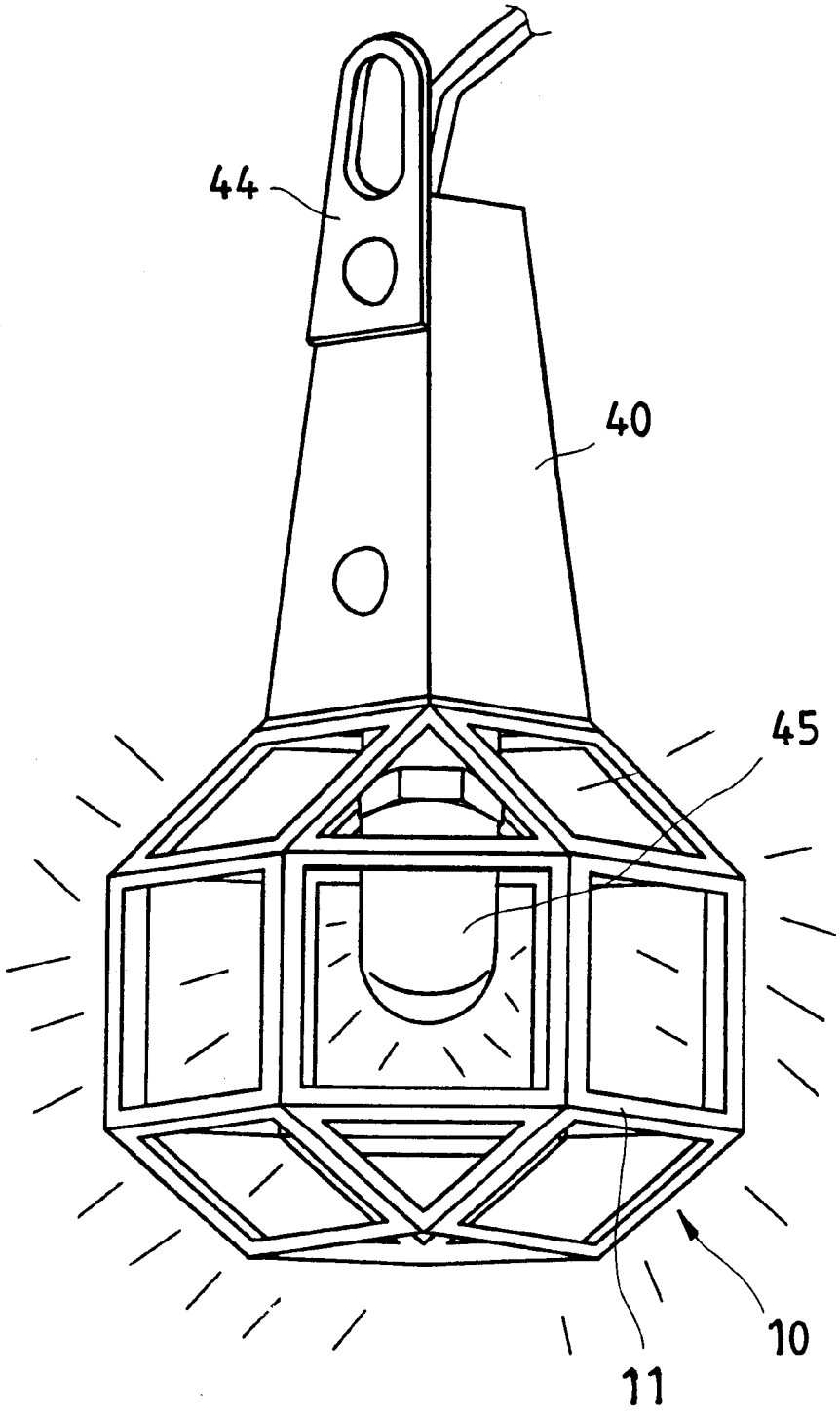
FIG. 4 illustrates the use of the present invention after removable of the ornamental quadrilateral pyramids and the ornamental triangular pyramids from the polygonal frame base.

Referring to FIG. 4, after removable of the ornamental quadrilateral pyramids 20 and the ornamental triangular pyramids 30 from the polygonal frame base 10, the lamp body 40 and the polygonal frame base 10 form a regular lamp for illumination. Because the lamp tube 45 is suspended in the polygonal frame base 10, it is well protected, and light from the lamp tube 45 passes through the openings 12 and 13 to illuminate the surroundings. Further, because the lamp tube 45 is protected in the polygonal frame base 10, this arrangement can be used as a work lamp; for example, this arrangement of shape lamp can be freely put on the floor when repairing the car. By means of the hanging plate 44, the shape lamp can be hung on the wall or the ceiling. The user can also hold the lamp body 40 to use this arrangement of shape lamp as a hand light.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A shape lamp comprising:

a hollow polygonal frame base, said hollow polygonal frame base comprising a plurality of frame ribs connected to one another and defining a plurality of rectangular openings and triangular openings;

a lamp body shaped like a quadrilateral pyramid and detachably fastened to said frame base, said lamp body comprising a bottom locating flange stopped against said frame ribs of said polygonal frame base around one rectangular opening of said polygonal frame base, a plurality of bottom hooks and bottom stop plates respectively engaged into one rectangular opening of said polygonal frame base to secure said lamp body to said polygonal frame base, a lamp tube disposed at a bottom side thereof and suspending in said polygonal frame base;

a plurality of ornamental quadrilateral pyramids selectively detachably fastened to said polygonal frame base, said ornamental quadrilateral pyramids each comprising a bottom locating flange stopped against the frame ribs of said polygonal frame base around one rectangular opening of said polygonal frame base, a plurality of bottom hooks and bottom stop plates respectively engaged into one rectangular opening of said polygonal frame base to secure the respective ornamental quadrilateral pyramid to said polygonal frame base; and a plurality of ornamental triangular pyramids selectively detachably fastened to said polygonal frame bases, said ornamental triangular pyramids each comprising a bottom locating flange stopped against the frame ribs of said polygonal frame base around one rectangular opening of said polygonal frame base, and a plurality of bottom hooks respectively engaged into one triangular opening of said polygonal frame base to secure the respective ornamental triangular pyramid to said polygonal frame base.

2. The shape lamp of claim 1 wherein said lamp body further comprises a hanging plate disposed at a topside thereof for hanging.

* * * * *